US009388544B2

(12) United States Patent
Reeves et al.

(10) Patent No.: US 9,388,544 B2
(45) Date of Patent: Jul. 12, 2016

(54) FINGER SNOW PLOW WITH EXTENSION

(75) Inventors: William J. Reeves, Mount Forest (CA); Gerald N. Simpson, Gowanstown (CA); Leo P. Manion, Priceville (CA); Amiya Mishra, Guelph (CA)

(73) Assignee: CIVES CORPORATION, Roswell, GA (US)

( * ) Notice: Subject to any disclaimer, the term of this patent is extended or adjusted under 35 U.S.C. 154(b) by 243 days.

(21) Appl. No.: 13/357,968

(22) Filed: Jan. 25, 2012

(65) Prior Publication Data

US 2013/0185962 A1 Jul. 25, 2013

(51) Int. Cl.
*E01H 5/06* (2006.01)
*E01H 10/00* (2006.01)

(52) U.S. Cl.
CPC ..... *E01H 5/065* (2013.01); *E01H 10/007* (2013.01)

(58) Field of Classification Search
CPC ..... E01H 5/067; E01H 5/062; E01H 10/007; E01H 5/065; E01H 5/06
USPC ..... 37/231, 266, 268, 274, 281
See application file for complete search history.

(56) References Cited

U.S. PATENT DOCUMENTS 204,031 A * 5/1878 Gruntler ..... 37/218
338,262 A 3/1886 Gibson
520,479 A * 5/1894 Bunnell ..... E02F 3/8152 172/701.3
1,064,282 A * 6/1913 Blake ..... E01H 5/063 37/232
1,383,409 A 7/1921 Liddell
1,492,120 A * 4/1924 Calabrese ..... 37/231
2,061,585 A 11/1936 Meyer
2,080,129 A * 5/1937 Gulotta ..... 15/250.41
2,116,351 A 5/1938 Jones et al.
2,218,512 A * 10/1940 Ball ..... 37/279
2,337,434 A 12/1943 Washbond
2,410,543 A * 11/1946 Kester ..... 37/231
2,690,902 A * 10/1954 Ream ..... E01H 5/12 172/40
2,962,821 A 12/1960 Peitl
3,074,190 A * 1/1963 Wahl ..... E02F 3/7604 172/136
3,086,303 A * 4/1963 Weeks ..... E01H 5/063 267/34
3,199,234 A 8/1965 Reissinger
3,241,254 A * 3/1966 Ulrich ..... E01H 5/067 172/782
3,425,497 A * 2/1969 Strabala et al. ..... 172/792
3,512,589 A * 5/1970 Ulrich ..... 172/786
3,720,010 A * 3/1973 Coates ..... E01H 5/067 172/780
3,755,930 A * 9/1973 Brandt et al. ..... 37/219
3,772,803 A 11/1973 Cote (Continued)

FOREIGN PATENT DOCUMENTS

CA 1291872 C 11/1991
CA 2125586 A1 12/1995
GB 784049 A * 10/1957 ..... E01H 5/062

*Primary Examiner* — Thomas B Will
*Assistant Examiner* — Joan D Misa
(74) *Attorney, Agent, or Firm* — Buchanan Ingersoll & Rooney PC

(57) ABSTRACT

A finger plow includes an extension which may be extended or retracted to enable the finger plow to discharge snow and ice away from the wheels of the vehicle and to make a relatively wider snow cleared path while not unduly extending beyond the sidewalls of the wheels of the vehicle when not engaged in a plowing operation. The finger plow may be a one-way or reversible snow plow with one or two extensions. In the later case, the finger plow and one or more extension finger plows are rotatable relative to the chassis of the vehicle. Shear pins or a resilient mechanism may be provided to permit the finger plow to pivot rearwardly in the event that the finger plow extension encounters an obstacle.

27 Claims, 19 Drawing Sheets

(56) References Cited

U.S. PATENT DOCUMENTS 3,803,733 A * 4/1974 Ramsey ..... 37/273
4,019,268 A * 4/1977 Waterman ..... 37/219
4,074,448 A * 2/1978 Niemela ..... 37/234
4,099,578 A * 7/1978 Stevens ..... 172/815
4,109,268 A * 8/1978 Schroter et al. ..... 396/574
4,249,323 A * 2/1981 Mathis et al. ..... 37/232
4,259,794 A 4/1981 Rath
4,275,514 A * 6/1981 Maura ..... 37/281
4,356,645 A * 11/1982 Hine et al. ..... 37/281
4,369,847 A * 1/1983 Mizunuma ..... 172/815
4,372,617 A * 2/1983 Zamboni ..... 299/24
4,406,113 A * 9/1983 Mullins ..... 56/400.16
4,479,312 A * 10/1984 Turgeon ..... 37/219
4,491,275 A * 1/1985 Holsworth ..... 239/663
4,570,366 A * 2/1986 Yost ..... 37/232
4,643,261 A * 2/1987 Long ..... E01H 1/056 15/82
4,669,205 A 6/1987 Smathers
4,671,363 A 6/1987 Bolinger
4,709,492 A 12/1987 Watson
4,741,116 A * 5/1988 Engle et al. ..... 37/280
4,794,710 A 1/1989 Häring
4,834,191 A * 5/1989 Vecchio ..... 172/784
4,852,337 A * 8/1989 Peterson ..... 56/8
4,907,357 A * 3/1990 Lilienthal ..... E01H 5/068 172/830
D310,225 S 8/1990 Eberle
4,962,600 A * 10/1990 Zellaha et al. ..... 37/280
5,058,295 A * 10/1991 Holland ..... E01H 5/068 172/445.1
5,079,866 A 1/1992 Farrell
5,140,763 A 8/1992 Nichols, IV
5,142,855 A 9/1992 Guidarelli
5,265,355 A * 11/1993 Daniels ..... E01H 5/068 37/231
5,285,588 A * 2/1994 Niemela et al. ..... 37/234
5,392,538 A * 2/1995 Geerligs ..... E01H 5/061 37/236
5,411,102 A * 5/1995 Nickels et al. ..... 172/781
5,437,113 A * 8/1995 Jones ..... 37/233
5,471,770 A 12/1995 Ferreira
5,497,569 A 3/1996 Byman
5,603,172 A * 2/1997 Maher ..... E01H 5/062 172/794
5,638,618 A * 6/1997 Niemela et al. ..... 37/281
5,655,318 A * 8/1997 Daniels ..... 37/231
5,695,013 A * 12/1997 Waldron ..... 172/784
5,697,172 A * 12/1997 Verseef ..... 37/232
5,720,122 A * 2/1998 McLellan ..... E01H 5/068 37/232
5,782,016 A * 7/1998 Feller ..... E02F 3/764 172/781
5,799,736 A * 9/1998 Waldron ..... 172/784
5,819,443 A 10/1998 Winter
5,860,230 A * 1/1999 Daniels ..... 37/232
5,890,546 A * 4/1999 Kerpash, Sr. ..... 172/684.5
5,899,007 A * 5/1999 Niemela et al. ..... 37/281
5,921,326 A * 7/1999 Ragule ..... 172/815
6,073,371 A * 6/2000 Goos ..... E01H 5/063 37/232
6,249,992 B1 * 6/2001 Irving et al. ..... 37/281
6,256,910 B1 7/2001 Grozde
6,324,775 B1 * 12/2001 Harnois et al. ..... 37/266
6,364,028 B1 * 4/2002 Ferrell et al. ..... 172/1
6,442,877 B1 * 9/2002 Quenzi et al. ..... 37/281
6,453,582 B1 * 9/2002 Fulton, III ..... 37/197
6,467,199 B1 * 10/2002 Christy ..... 37/234
6,688,021 B2 * 2/2004 Baig et al. ..... 37/214
6,751,894 B2 * 6/2004 Verseef ..... 37/266
6,823,615 B2 * 11/2004 Strait ..... 37/233
6,874,260 B2 * 4/2005 Mullett ..... E01H 5/06 172/747
6,941,685 B2 * 9/2005 Goy ..... E01H 5/063 172/816
6,996,925 B2 2/2006 Harding
7,107,709 B2 * 9/2006 Hamel ..... 37/232
7,108,196 B2 * 9/2006 Kime ..... 239/1
7,134,227 B2 * 11/2006 Quenzi et al. ..... 37/274
7,146,754 B2 12/2006 Schultz et al.
7,263,789 B2 * 9/2007 Hollinrake et al. ..... 37/231
7,555,853 B2 * 7/2009 Paonessa ..... 37/232
7,584,557 B1 * 9/2009 Nistler ..... 37/274
7,658,236 B2 * 2/2010 Howson ..... E02F 3/3604 172/272
7,681,337 B2 * 3/2010 Watson ..... 37/281
7,730,643 B2 6/2010 Mishra et al.
7,730,644 B2 * 6/2010 Frey et al. ..... 37/274
7,793,740 B2 * 9/2010 Thomson et al. ..... 172/795
7,934,328 B2 * 5/2011 Gamble, II ..... 37/273
7,980,328 B2 * 7/2011 Hallworth ..... E21B 7/06 175/61
8,528,237 B1 * 9/2013 Bacall ..... E01H 5/04 37/231
2003/0226289 A1 * 12/2003 Geerligs ..... 37/268
2010/0064554 A1 * 3/2010 Ropog ..... 37/197

* cited by examiner

FINGER SNOW PLOW WITH EXTENSION

FIELD OF THE INVENTION

The present invention relates to plows and more particularly relates to plowing arrangements for clearing snow from pavement such as a road, a highway or a runway as well as to methods of clearing snow from pavement.

BACKGROUND OF THE INVENTION

An accumulation of snow is usually removed from pavement by a truck that is provided with a snow plow having a moldboard mounted on the front end of the truck. Typically, the plowing operation leaves some amount of snow or ice or slush on the pavement being cleared. When the snow or ice is packed down on the pavement surface, the ability of the moldboard to remove all or substantially all of the snow and ice is significantly reduced.

During a plowing operation, it is conventional to raise and lower the moldboard of the snow plow as desired and to change the angle that the moldboard of the snow plow makes with the longitudinal center axis of the truck, and therefore with respect to the longitudinal axis of the lane of pavement being cleared.

The moldboard of the snow plow may be selectively raised and lowered so that the plow truck may be driven with the lowermost edge of the moldboard either in contact (for conducting a plowing operation) or out of contact with the road, such as when the truck is being driven over pavement which has already been cleared of snow. Also, the snow plow is typically arranged to enable the angle of the plow with respect to the truck to be changed so that the snow plow can be used to divert snow to the left or to the right of the truck or used to push snow directly in front of the truck such as when clearing a driveway or parking lot.

A wing plow or another attachment may be provided to effectively extend the width of the lane that can be plowed by a single truck in a single pass. Such wing plows are typically mounted at one side of the truck. Snow plow vehicles at airfields may sometimes have a front plow blade and a broom which is towed by the vehicle.

In U.S. Pat. No. 7,730,643, a Two-Stage Snow Plow is disclosed. In a preferred embodiment of that patent, a secondary plow is provided behind a main snow plow or moldboard, with the secondary plow formed of a plurality of resilient fingers. The secondary plow typically removes snow and ice that has been packed down onto the pavement and is difficult to remove with the main snow plow. In certain preferred embodiments, the secondary plow is configured to allow translation of the secondary plow relative to the main plow in a direction that is substantially parallel to the main plow scraping edge so that left and right ends of the secondary plow are substantially aligned with the respective left and right ends of the main plow.

The finger plow of U.S. Pat. No. 7,730,643 can be mounted in various positions on a vehicle. For example, the finger plow may be fixedly mounted underneath the chassis of a truck between the front and rear wheels. In that arrangement, the finger plow is preferably actuated by a hydraulic cylinder that raises the fingers out of engagement with the pavement and lowers the fingers into engagement with the pavement during plowing operations.

Especially when the finger plow is fixedly mounted beneath a truck, it is desirable to not have the ends of the finger plow extend significantly beyond the outermost edges of the tires of the vehicle. As a result, in such an arrangement, the secondary plow tends to discharge snow and ice adjacent or substantially in the path of the wheels of the vehicle, especially when a snow removing truck with a finger plow deployed is moving slowly in heavy traffic or is moving in an urban area where the snow and ice may remain on the pavement and be packed down by the wheels of the vehicle or by other vehicles.

The need remains for a finger plow arrangement in which the snow and ice which is removed from the pavement by the finger plow is discharged away from the vehicle so that the snow and ice is unlikely to be packed down by the wheels of the vehicle and wherein the finger plow may be configured so as not to extend substantially beyond the outermost edges of the vehicle when the finger plow is not engaged in a plowing operation.

SUMMARY OF THE INVENTION

In one embodiment, a snow plow to be mounted on a vehicle comprises a first frame and a first plurality of fingers with each finger of the first plurality of fingers having a substantially straight portion and a substantially curved portion. The first plurality of fingers is carried by the first frame to form a finger plow for collecting snow and/or ice from pavement. The snow plow also comprises a second frame and a second plurality of fingers with each finger of the second plurality of fingers having a substantially straight portion and a substantially curved portion. The second plurality of fingers is carried by the second frame to form an extension of the finger plow with the second frame being movable relative to the first frame. In this way, an outermost end of the extension of the finger plow selectively extends beyond an end of the finger plow.

In another embodiment, the second frame is carried by the first frame for sliding movement of the second frame relative to the first frame.

In another embodiment, a hydraulic cylinder is arranged to extend and retract the second frame relative to the first frame.

In another embodiment, the snow plow further comprises a bracket, with the second frame being pivotably mounted on the bracket for rotation about a substantially vertical axis. The bracket preferably comprises a release mechanism which releasably prevents pivotal movement of the second frame relative to the bracket and the bracket has at least one shear pin which prevents the pivotal movement of the second frame relative to the bracket unless the shear pin is broken.

In another embodiment, the snow plow further comprises a bracket, with the second frame being pivotably mounted on the bracket for rotation about a substantially vertical axis. The bracket preferably comprises a resilient mechanism which resiliently prevents pivotal movement of the second frame relative to the bracket. The resilient mechanism may comprise a spring that is compressed when the second frame pivots rearwardly. The resilient mechanism may comprise a spring that is stretched when the second frame pivots rearwardly.

In another preferred embodiment, the resilient mechanism may comprise a set of leaf springs. The resilient mechanism may comprise a chamber filled with a compressible fluid, with the chamber being compressed when the second frame pivots rearwardly.

In another embodiment, the snow plow further comprises a chain with a first end of the chain being attached to the bracket and a second end of the chain being attached to the finger plow extension to limit rotation of the finger plow extension relative to the bracket when the shear pin is broken.

In another embodiment, the finger plow extension further comprises a trip mechanism which is provided at an outermost end of the finger plow extension. The trip mechanism of the finger plow extension may comprise a spring-biased member configured to urge an end portion of the finger plow extension into a plowing position. A finger plow with a spring-biased trip mechanism is preferable because the trip mechanism oscillates a one-piece carbide edge as the edge of a finger of the finger plow extension. The spring-biased member preferably enables the end portion of the finger plow extension to deflect away from the plowing position.

In another embodiment, the snow plow further comprises first and second mounting brackets for attaching the first frame of the finger plow to the vehicle. The snow plow is preferably attached underneath the vehicle and between the front wheels and the rear wheels of the vehicle.

The frame may be fixedly mounted to the vehicle to discharge snow and ice to a right side of the vehicle or the finger plow may be a reversible plow with the frame of the finger plow being movably mounted to the vehicle to discharge snow and ice selectively to a right side of the vehicle or to a left side of the vehicle.

The extension of the finger plow may be provided on a right end of the finger plow to form a right end extension of the finger plow. The snow plow may further comprise a third frame with a third plurality of fingers. Each finger of the third plurality of fingers may have a substantially straight portion and a substantially curved portion with the third plurality of fingers being carried by the third frame to form a left end extension of the finger plow. The third frame is preferably movable relative to the first frame whereby the extension of the finger plow selectively extends beyond a left end of the finger plow.

A spreader for salt and sand may be provided adjacent a right end of the finger plow for left side discharge. A spreader for salt and sand may be provided adjacent a left end of the finger plow, especially when the finger plow is arranged for right side discharge.

The snow plow may further comprise a plurality of cable brackets with each cable bracket being mounted on one of the first and second plurality of fingers. A cable may connect the plurality of cable brackets so that a finger which becomes broken may be retained by the cable during a plowing operation.

Additional features and advantages of the invention will be set forth or be apparent from the description that follows. The features and advantages of the invention will be realized and attained by the structures and methods particularly pointed out in the written description and claims hereof as well as the appended drawings. It is to be understood that both the foregoing general description and the following detailed description are exemplary and explanatory and are intended to provide further explanation without limiting the scope of the invention as claimed.

BRIEF DESCRIPTION OF THE DRAWING FIGURES

Several preferred embodiments of the invention are illustrated in the enclosed Figures in which.

DETAILED DESCRIPTION OF THE PREFERRED EMBODIMENTS

Figure 1:
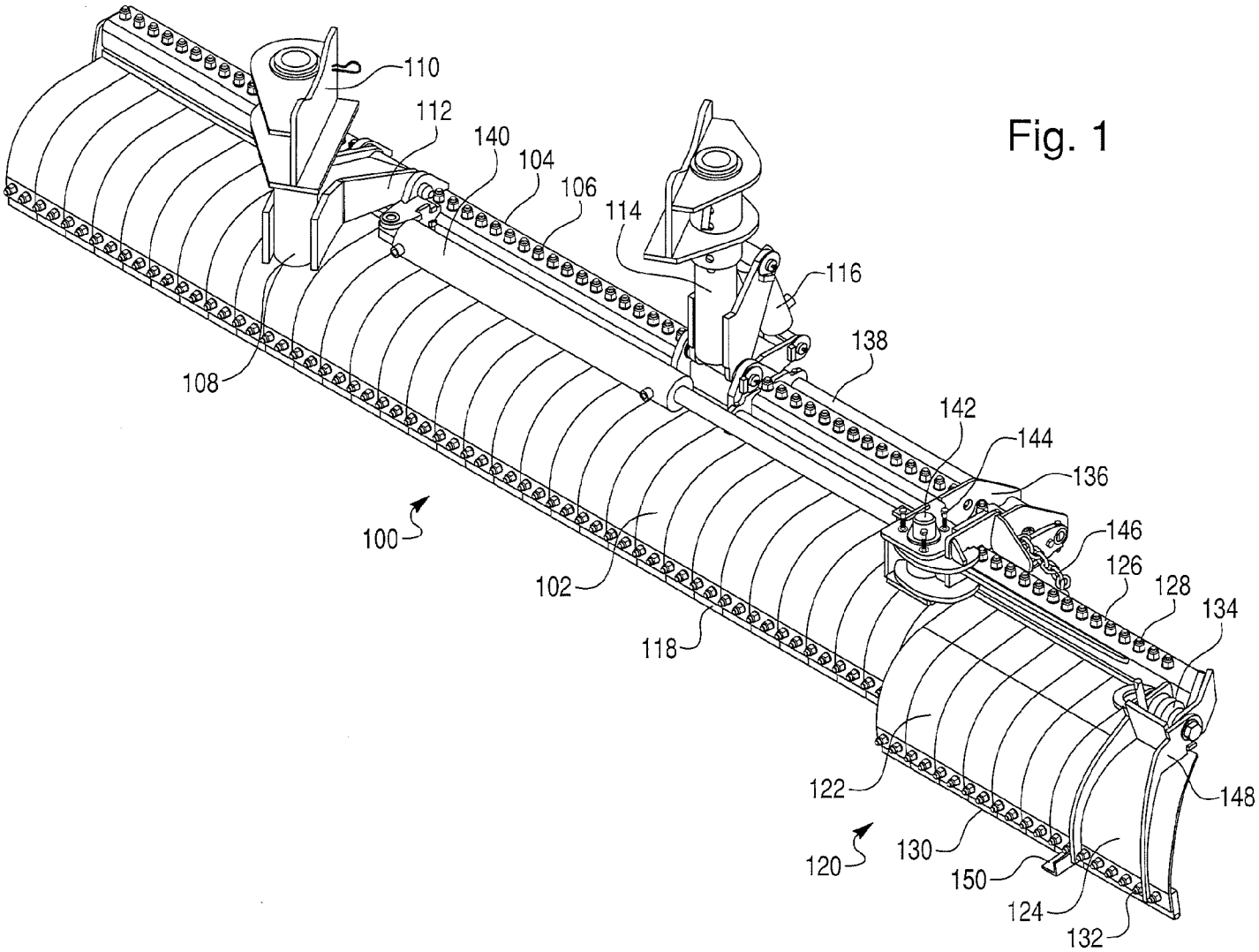
FIG. 1 is a rear perspective view of a preferred embodiment of a finger plow with an extension in an extended position.

With reference to FIG. 1, a finger plow 100 is formed by a plurality of individual fingers 102 which are secured to and removable from a first frame member 104 using, e.g., removable bolts 106. The first frame member 104 may comprise a U-channel, a section of angle iron, an I-beam, a round tube or any other similarly suited supporting structure. In the embodiment of FIG. 1, the first frame member 104 is carried by a first support 108 which extends downwardly. At the top of the first support 108, an L-shaped seat 110 for a chassis rail is provided. A vertical plate of the L-shaped seat is bolted (the bolts are not shown) to a vertical leg of the I-beam of the left hand chassis rail of a vehicle such as a snow plow truck or a dumping and spreading truck for salt and sand. At least one support arm 112 is attached to the lower end of the first support 108 to pivotably carry one side of the first frame member 104. The support arm 112 extends away from the first support 108 at an angle so that the finger plow 100 may be configured to discharge snow and ice to the right side of the vehicle.

The first frame member 104 is also carried by a second support 114 which extends downwardly. The second support 114 has an L-shaped rail seat whose vertical plate at the top is bolted to a vertical leg of the I-beam of the right hand chassis rail of the vehicle, as described previously (see also FIG. 5A). A hydraulic cylinder 116 is provided to selectively rotate the finger plow about a horizontal axis to thereby raise and lower the fingers 102 with respect to the pavement to be plowed. Preferably, the hydraulic cylinder 116 is remotely controlled from the cab of the vehicle (not shown). The hydraulic cylinder 116 preferably provides an appropriate and steady pressure for the fingers 102 to scrape the residual snow and ice from the pavement. The appropriate pressure provided by the hydraulic cylinder to urge the fingers 102 against the pavement is dependent on the condition of snow (i.e., lightly packed to highly packed snow) on the road. The pressure can be set as well as monitored accurately at a gauge installed in a cab of the vehicle, through-out the plowing operation.

In the preferred embodiment of FIG. 1, the finger plow 100 extends generally between the outermost edges of the tires of the vehicle so that the finger plow does not inadvertently engage other vehicles or obstructions such as curbs, etc. especially when the finger plow is not being used in a plowing operation.

The finger plow 100 has the plurality of individual fingers 102 arranged along the length of the first frame member 104 to form a scraping edge for the finger plow. The finger plow is especially useful to remove residual snow left behind by a moldboard either mounted on the front of the vehicle or which was used in a separate plowing operation by another vehicle.

In the preferred embodiment, the individual fingers 102 are urged downward by a hydraulic cylinder 116. Alternatively, one or more springs may be used to urge the fingers into engagement with the pavement but it is preferred to use a controllable hydraulic cylinder because it may be difficult for one or more springs to provide a relatively constant amount of downward pressure on the fingers 102, especially by one or more coil springs. Further, the coil springs may not deliver a relatively constant pressure at the tips of the fingers because of the shortening of the fingers at the ends or tips as the fingers start to wear during a plowing operation.

If the fingers 102 were urged downwardly by coil springs, the downwardly directed pressure exerted by the coil springs may not be easily compensated as the fingers 102 wear. Therefore, the downwardly directed pressure exerted by the coil spring will tend to decrease as the fingers erode and get shorter and shorter. In order to scrape the snow and ice from the road efficiently, in the preferred embodiments an appropriate and steady downwardly directed pressure is applied by the tips of the fingers or tines against the pavement during the entire plowing operation. Of course, an arrangement, not shown, could readily be provided for adjusting (either automatically or manually) the downward force applied by one or more coil springs to the tips of the fingers against the pavement.

As mentioned earlier, the fingers 102 form a scraping edge to remove snow and ice, especially residual snow left behind by a moldboard. Each finger 102 has a first portion that is curved, preferably substantially semi-circular in shape, and a second portion that is generally straight. The fingers are made from flat spring steel, preferably one-piece, and are configured in a way that the fingers can be secured with nuts and bolts at the top of the main frame 104. The fingers are configured so as to be readily available for replacement. When the finger plow 100 is mounted on a vehicle, the fingers 102 will extend in a concave manner as viewed from the front of the vehicle. The fingers 102 may be one-piece but, especially when formed from spring steel, can erode at an undesirable rate. A two piece finger 102 was therefore employed. In this configuration, each finger 102 has a first part made of spring steel and a tip 118 made of carbide that is bolted to the first part. The carbide tip 118 may form a portion of the curved section of the finger 102 or a straight part secured at the distal end of the finger. The configuration of the fingers 102 also allows the individual carbide tipped cutting edge to be mounted and secured at a lower straight part of the finger 102. As discussed below, the individual fingers of the finger plow extension are configured in the same way as the fingers 102 of the finger plow 100.

In a preferred embodiment, the spacing between adjacent fingers is preferably about 1/32 of an inch or about 1/16 of an inch. In the preferred embodiment, the fingers do not overlap one another because overlapped fingers would be unduly rigid and would be effectively prevented from individually following the contour of the road or pavement. As a result, the scraping ability of overlapping fingers is relatively poor and inefficient. On the contrary, when the fingers or tines are not overlapped, the fingers are flexible and able to oscillate.

Oscillating fingers are considered to be especially desirable for scraping bonded snow and ice because the oscillating fingers provides an impact force against the packed snow and ice when they oscillate (move back and then forth) during the plowing operation.

In the preferred embodiments, the concave portion of the fingers 102 are substantially semi-circular with two substantially tangential straight top and bottom end portions. The bottom straight end portion of the fingers together essentially function as the blade of a plow even though the individual fingers are spaced apart from one another. The top straight portion is fastened to the first frame member 104. The bottom straight portion, i.e., the portion in contact with pavement, is made from carbide or another sufficiently hard material. The inside surface of the arrangement of fingers formed by the lower relatively flat lower portion and the curved semi-circular portion may be made relatively smooth to essentially provide a continuous surface for facilitating efficient snow and ice flow along the plurality of fingers 102.

In the preferred embodiments, the uppermost portion of each individual finger 102 is not inclined with respect to the plowing direction because such an incline would tend to pack the snow and thereby clog the flow of snow and ice along the inside surface of the finger plow 100.

In the preferred embodiments, the angle that the fingers 102 make with the pavement (while the vehicle is not moving) is almost vertical, with an angle of about 85 to 90 degrees preferred, and an angle of close to 90 degrees being most preferred. The fingers 102 are preferably inclined more than 45 or 50 degrees (like a plow blade) because a more shallow angle typically cannot take off hard snow pack and ice. Instead, the fingers would tend to slide over hard packed snow.

In one embodiment of the finger plow 100, thirty-two fingers are arranged along the first frame member 104, with a 1/32 inch to 1/16 inch gap provided between adjacent fingers. The fingers are composed of a flat spring bar which is 3½ inches wide and ¼ inch to 0.270 inches thick and shaped to an overall height of 8 13/16 inches with a depth of 14⅝ inches. The top horizontal arm is 7¾ inches long and the bottom vertical arm is 2 1/16 inches long with the curved section having a radius of 6⅝ inches. In another embodiment, the bottom vertical arm may be made of carbide or another relatively hard material.

With continued reference to FIG. 1, the snow plow further comprises an extension 120 of the finger plow 100. The extension 120 is movable relative to the first frame 104 so that an outermost end of the extension 120 of the finger plow may selectively extend beyond an end of the finger plow 100. The extension 120 is formed by several fingers 122 which correspond generally to the fingers 102 of the finger plow 100. Depending on the desired length of the extension 120, the number of fingers 122 which comprise the extension may vary. In a preferred embodiment, the extension 120 has seven fingers 122 along with a trip finger 124 provided at the outermost end of the extension 120.

The fingers 122 that comprise the extension 120 are carried by a second frame member 126. The fingers 122 are bolted to the second frame member 126 by removable bolts 128 so that the fingers 122 may be replaced as needed. Similarly, the fingers 122 of the extension may be of one piece or preferably have a carbide tip 130 which is bolted to a lowermost end of the finger 122 as described above in connection with the fingers 102 of the finger plow 100. The fingers 122 of the extension likewise have a curved and straight configuration that preferably corresponds to the configuration of the fingers 102 of the finger plow 100.

The trip finger 124 is preferably generally triangular in shape so that the lower portion of the trip finger 124 is wider than the upper portion. The trip finger 124 may be provided with a carbide tip 132 which is bolted to a lowermost portion of the trip finger 124. The trip finger 124 is curved to correspond to the curvature of the fingers 122 of the extension so that the extension provides a relatively smooth surface for directing snow and ice to the side of the pavement being plowed.

The trip finger 124 is carried by the second frame member 126 so that the trip finger may pivot upwardly in the event that the trip finger encounters an obstacle such as a bump in the pavement. The trip finger 124 is preferably biased downwardly by a spring 134 which is compressed when the trip finger pivots upwardly relative to the pavement. The trip finger acts like a finger of the finger plow extension as it oscillates vertically. The trip finger 124 is preferably provided with support ribs on the rearward side of the trip finger to provide rigidity for the trip finger 124. The support ribs 148 also provide a framework for the spring 134 to urge downwardly. In addition, a trip finger positioner 150 may be provided and secured at a lowermost portion of the adjacent finger 122. In this way, overlapping by the trip finger 124 with the adjacent finger 122 is avoided.

Figure 4:
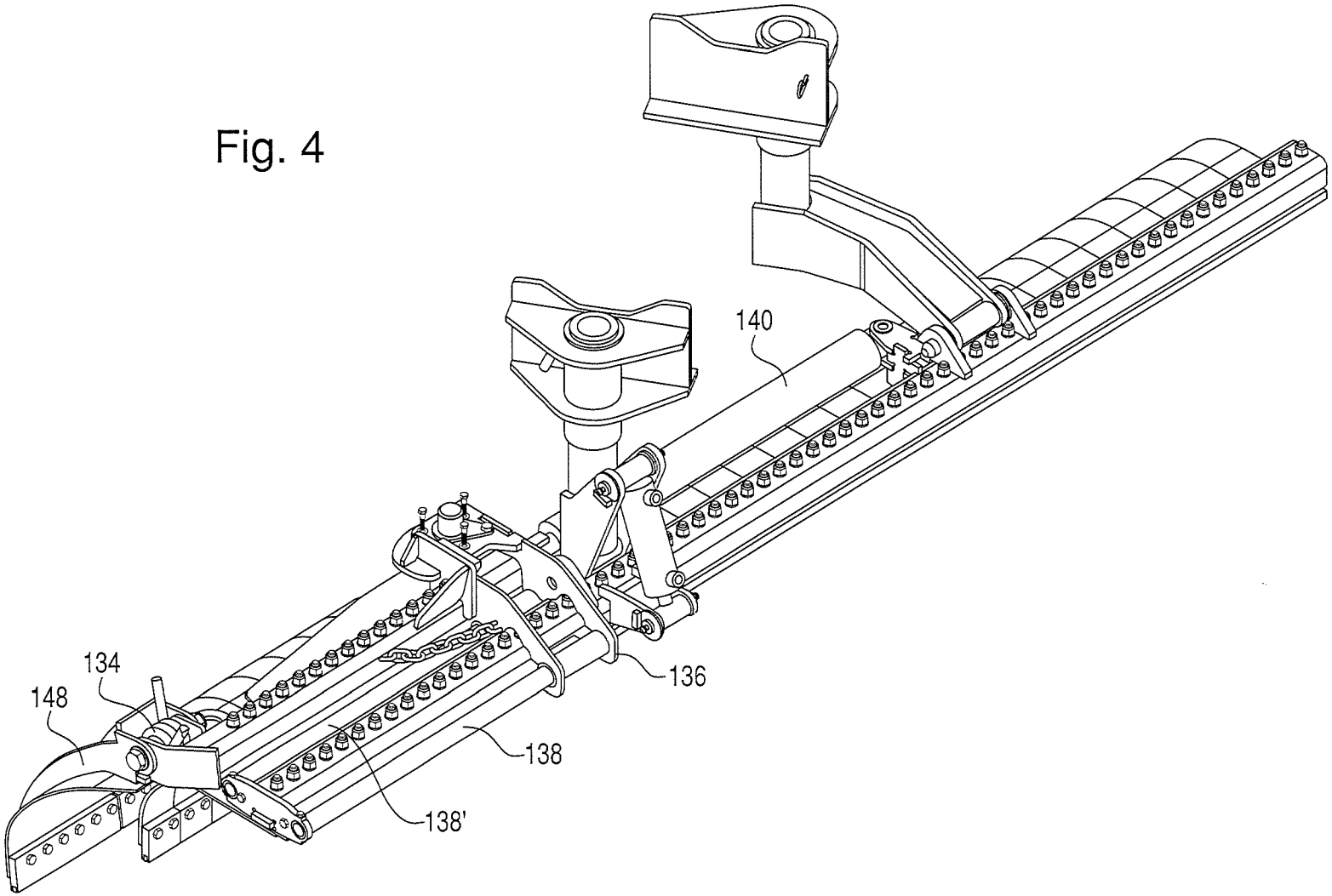
FIG. 4 is a front perspective view of a preferred embodiment of a finger plow with an extension in a retracted position.

The extension 120 is carried by a bracket 136 which is configured to travel along a shaft 138 (see also FIG. 4). The bracket 136 is arranged to slide along the shaft 138 to selectively position the extension 120 relative to the finger plow 100. A hydraulic cylinder 140 is provided between the extension 120 and the finger plow 100 to selectively move the extension between a retracted or storage position in which the extension does not extend substantially beyond the outermost end of the finger plow 100 and an extended or plowing position in which the extension 120 is moved outwardly relative to the finger plow. The hydraulic cylinder is preferably remotely controlled from a cab of the vehicle. In the embodiment of FIG. 1, the extension 120 is shown in the outermost plowing position with the bracket 136 adjacent the end of the finger plow 100.

Figure 2:
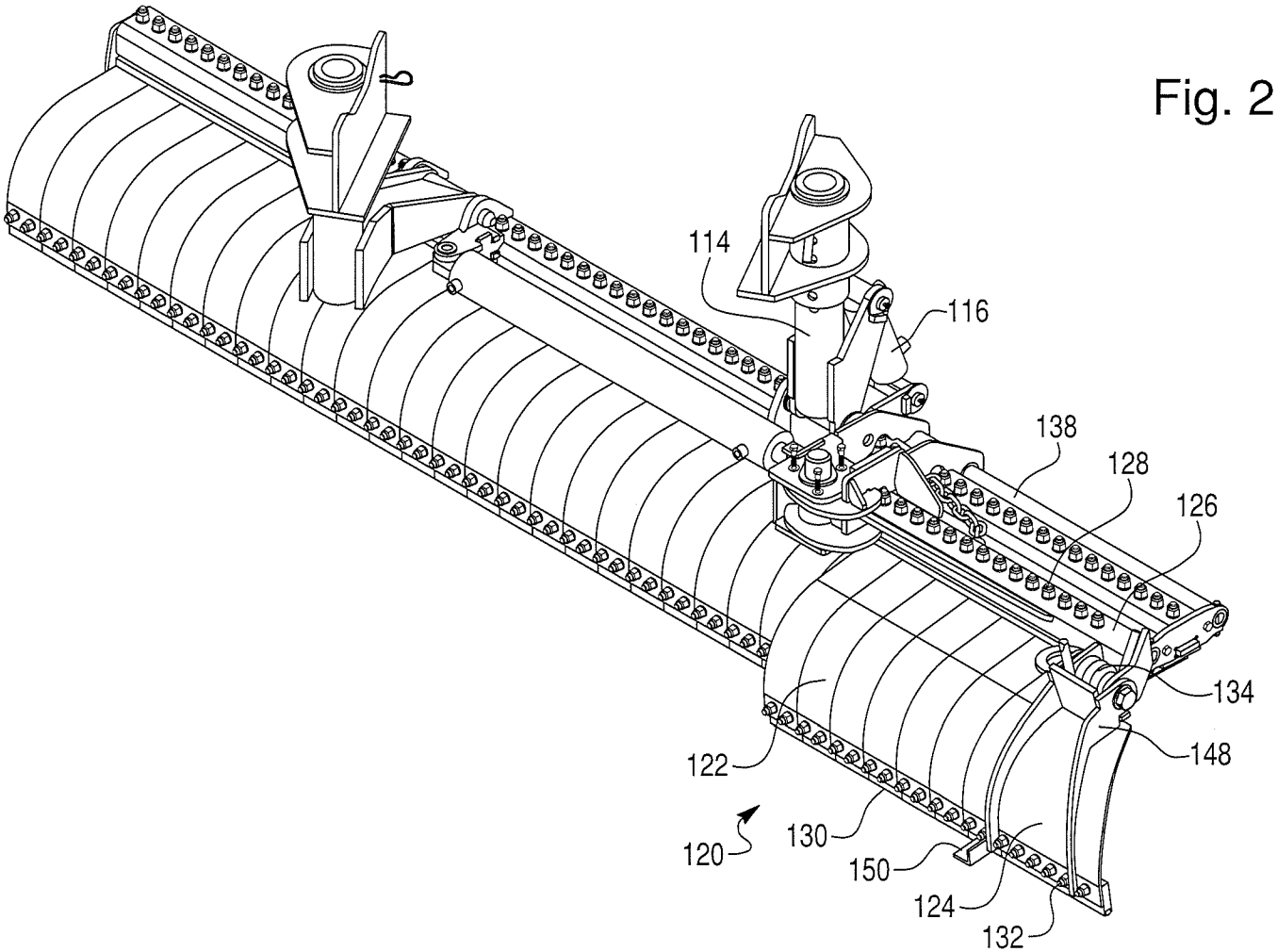
FIG. 2 is a rear perspective view of a preferred embodiment of a finger plow with an extension in a retracted position.

With reference now to FIG. 2, the extension 120 is shown in the retracted or storage position. As shown in FIG. 2, the hydraulic cylinder 140 has been retracted to move the extension 120 to the left relative to the finger plow (in a right discharge configuration for the finger plow 100). As desired, the extension may be configured so as not to extend beyond the outermost end of the finger plow 100 when the extension is fully retracted or the extension may protrude a small amount beyond the end of the finger plow 100.

Figure 3:
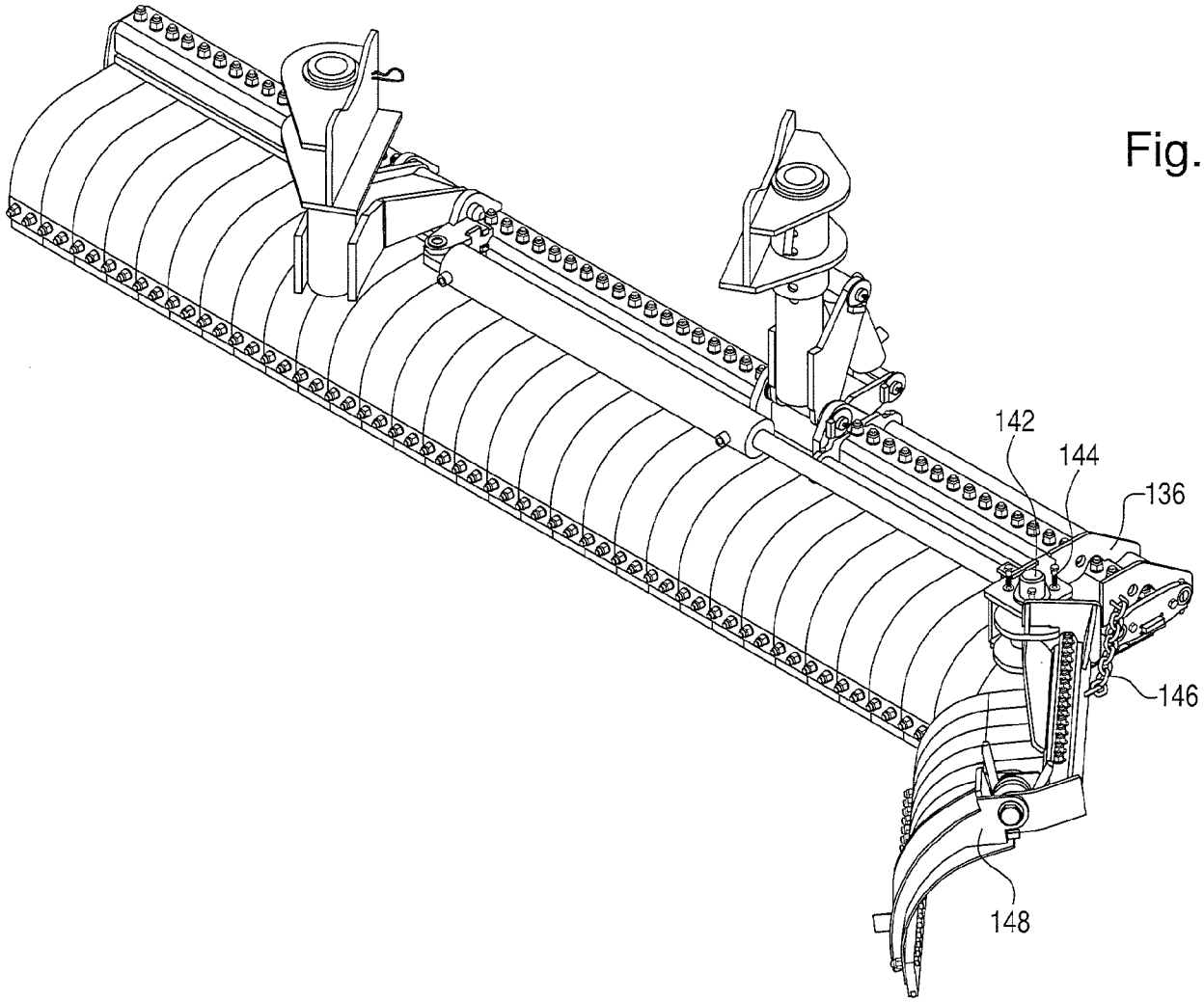
FIG. 3 is a rear perspective view of a preferred embodiment of a finger plow with an extension angled rearwardly.

With reference now to FIG. 3, the extension 120 is pivotably mounted on the bracket 136 for rotation about a pin 142. The extension is preferably maintained in a fixed position relative to the bracket 136 by several shear pins 144 which pass through the bracket 136 and through a portion of the extension 120. In the event that the extension encounters an obstruction with sufficient force to break the shear pins, the extension 120 is then permitted to pivot rearwardly as shown. A chain 146 is provided between the bracket 136 and the extension 120 to limit the pivotal movement of the extension 120 relative to the bracket 136. In this way, the chain prevents the extension from impacting the finger plow 100.

Figure 7:
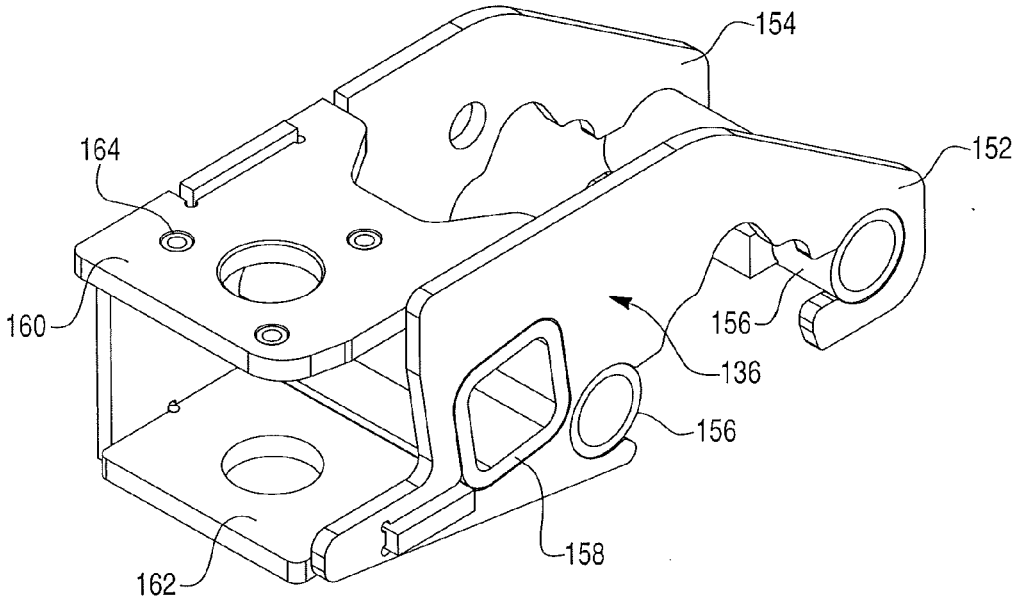
FIG. 7 is a right side perspective view of a preferred embodiment of a bracket for an extension for a finger plow.

With reference to FIG. 4, the extension 120 is shown in the retracted position behind the finger plow 100. The bracket 136 is mounted for sliding movement along the shaft 138. To provide additional support and to maintain the extension in a proper orientation relative to the finger plow 100, a second shaft 138' is provided behind the first frame member 104. With reference also to FIG. 7, the bracket 136 has a first sidewall 152 and a second sidewall 154 which form a slot for the shafts 138, 138'. To facilitate proper alignment of the bracket 136 on the shafts and to prevent binding, the bracket 136 has bushings or tubes 156 carried by the sidewalls 152, 154. The bushings 156 receive the shafts 138, 138'.

The sidewalls 152, 154 of the bracket are also joined together by a box beam 158. An upper plate 160 and a lower plate 162 are carried by the sidewalls with a hole extending vertically through the upper plate 160 and the lower plate 162 to receive the pin 142. The upper plate 160 also has holes 164 configured to accept hardened and ground shearing bushings which receive the shear pins 144 as discussed above. The hardened bushings help to shear the shear pins 144 in a more efficient manner without damaging the holes 164 in the upper plate 160 in the event that an obstruction is encountered, as discussed above.

Figure 6A:
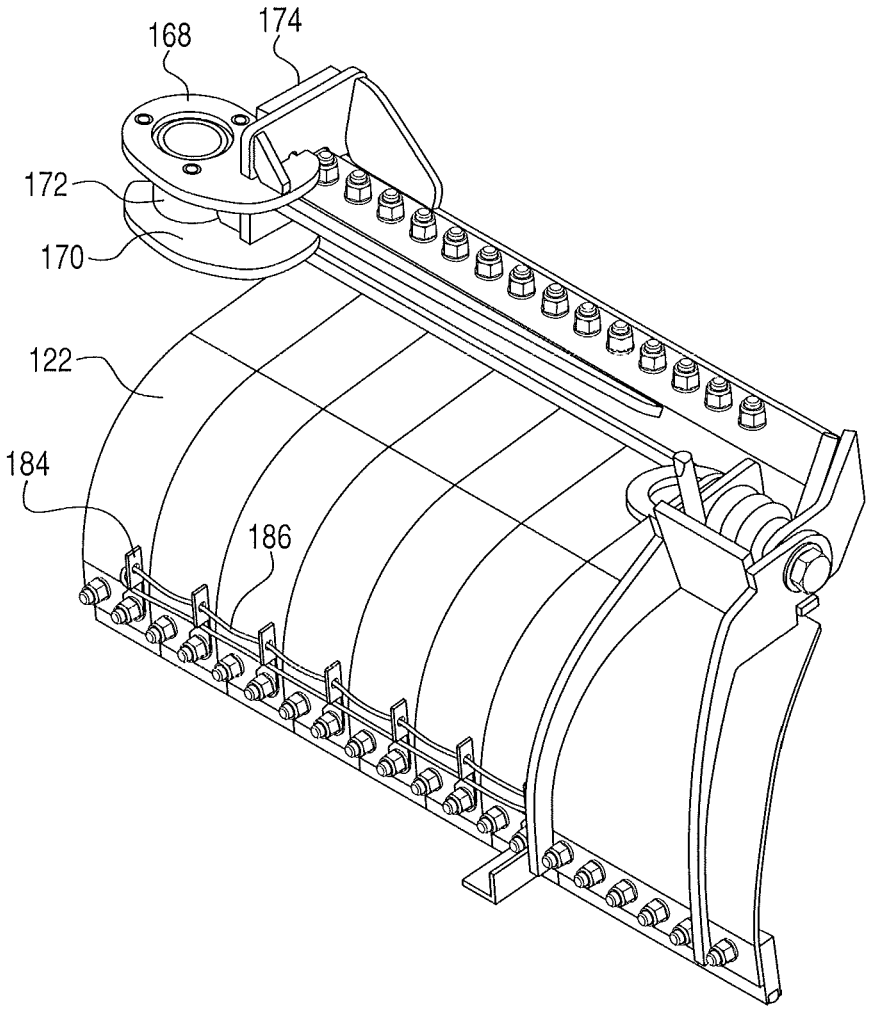
FIG. 6A is a rear perspective view of a preferred embodiment of an extension for a finger plow and FIG. 6B is a rear perspective view of a preferred embodiment of a finger plow.
Figure 8:
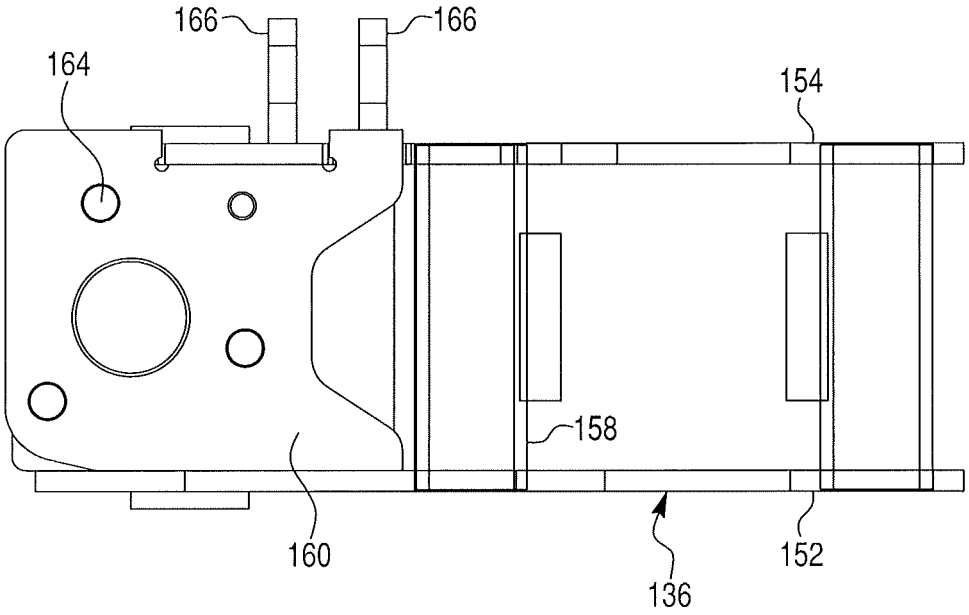
FIG. 8 is a top view of the bracket of FIG. 7.
Figure 9:
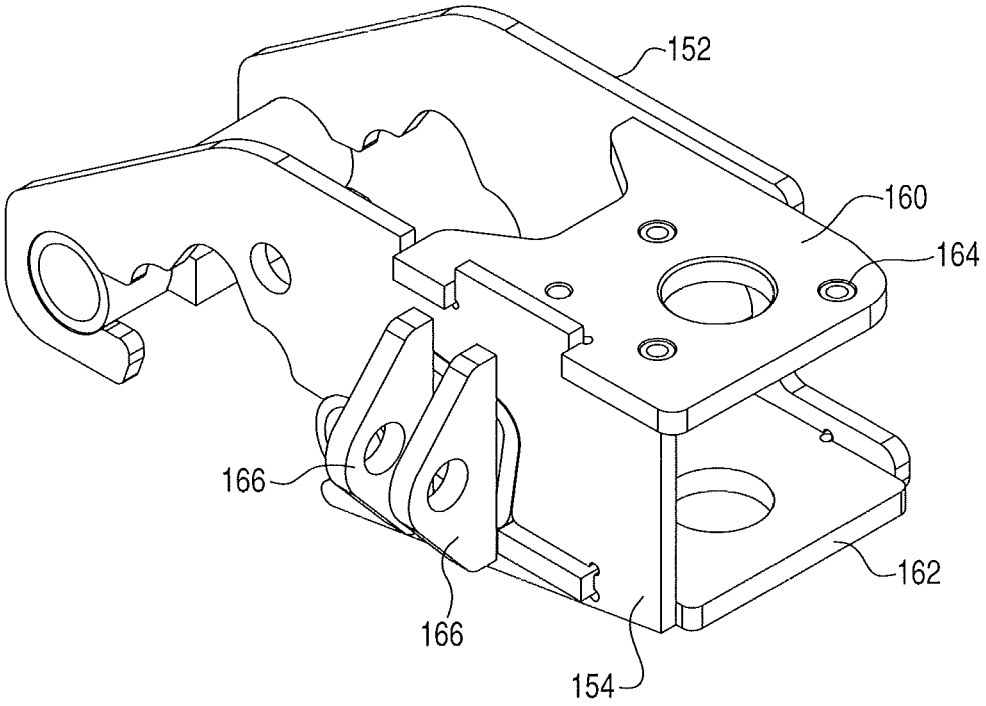
FIG. 9 is a left side perspective view of the bracket of FIG. 7.

With reference now to FIG. 8, the bracket 136 also has two arms 166 which receive one end of the hydraulic cylinder 140 (see also FIG. 9). With reference to FIG. 6A, the extension 120 of the finger plow has an upper plate 168 and a lower plate 170 which are fixedly mounted on the second frame member 126. The plates 168, 170 have a bushing 172 provided between the plates to receive the pin 142. The upper plate 168 has holes suited to accept hardened steel bushings which receive the shear pins 144 when the upper and lower plates 168, 170 are received between the upper and lower plates 160, 162 of the bracket 136. The extension 120 also has a shoulder 174 which is welded to a side plate and which rides and stays on top of the side wall of the plate 152 to support the extension 126 (and to keep the extension from hanging downwardly when the extension is raised from the pavement. By riding on the side wall of the plate 152 of the bracket 136, the shoulder 174 helps to align the steel hardened bushings in the upper plate 168 in the extension 126 and in the plate 160 in the bracket 136 in case the shear pin needs to be reinstalled (if they become sheared). Forward movement of the extension about the pin 142 is limited by butting the shoulder 174 against the plate 152.

Figure 6B:
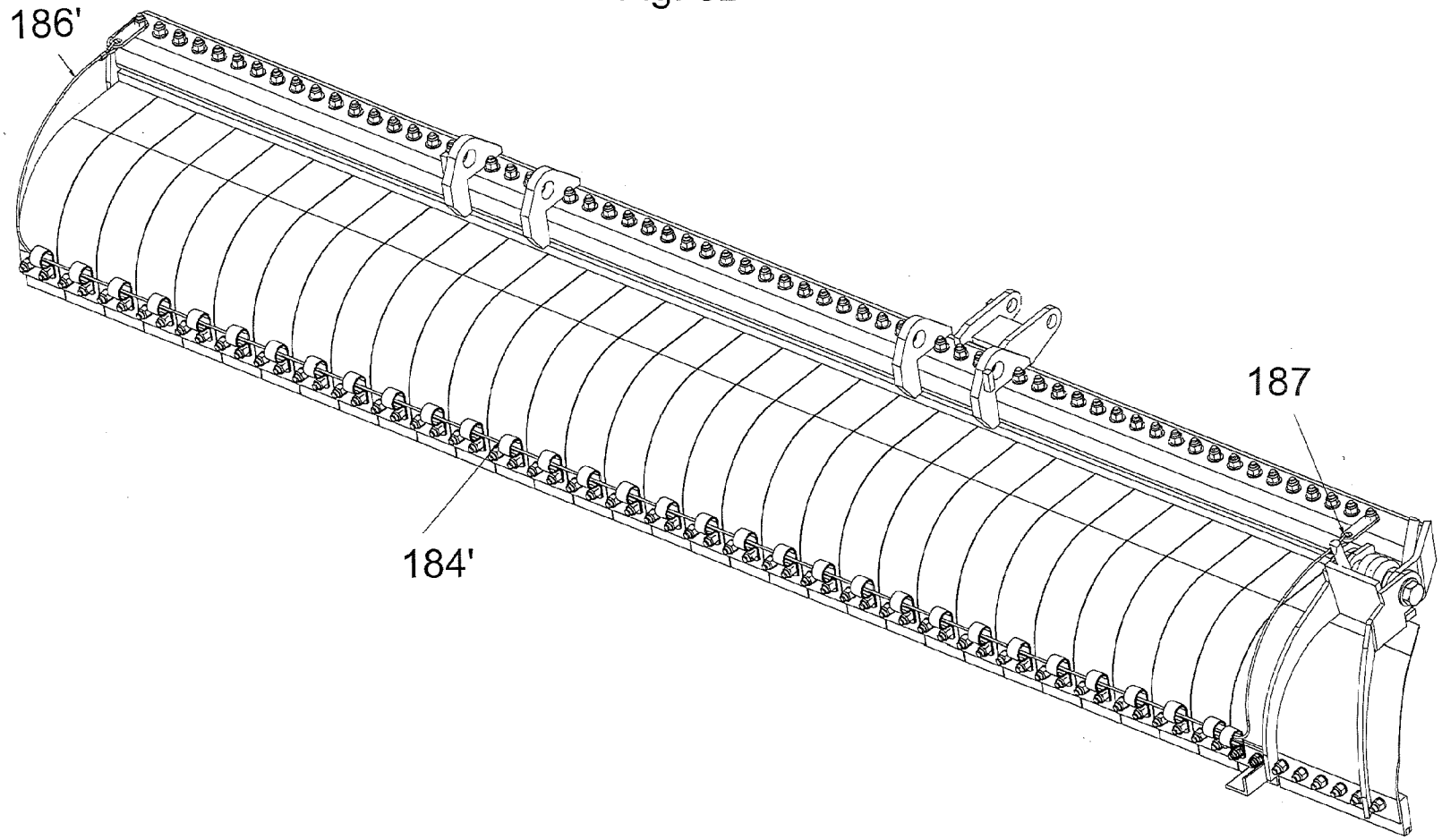

In the extension shown in FIG. 6A, a bracket 184 is provided at the lowermost end of each finger 122. Each bracket 184 has a hole which receives a cable 186 that forms a loop through the brackets. In this way, if an individual finger 122 of the extension should break, the loose portion of the finger would be retained by the bracket 184 of that finger and by the cable 186. In this way, a broken finger is prevented from flying off and possibly damaging a nearby vehicle or property. If desired, similar brackets and cables could be provided for the finger plow 100 with either all of the fingers joined together or groups of fingers joined together as desired. The cable is only loosely connected to the brackets, however, to enable individual fingers to flex during a plowing operation. With reference to FIG. 6B, a preferred form of the bracket 184' is shown mounted at the end of each finger of a finger plow with a cable 186' running through each bracket 184'. The cable 186' is mounted to the finger plow by a bracket 187 on the right hand side of the finger plow and by a similar bracket on the left hand side of the finger plow.

Figure 5A:
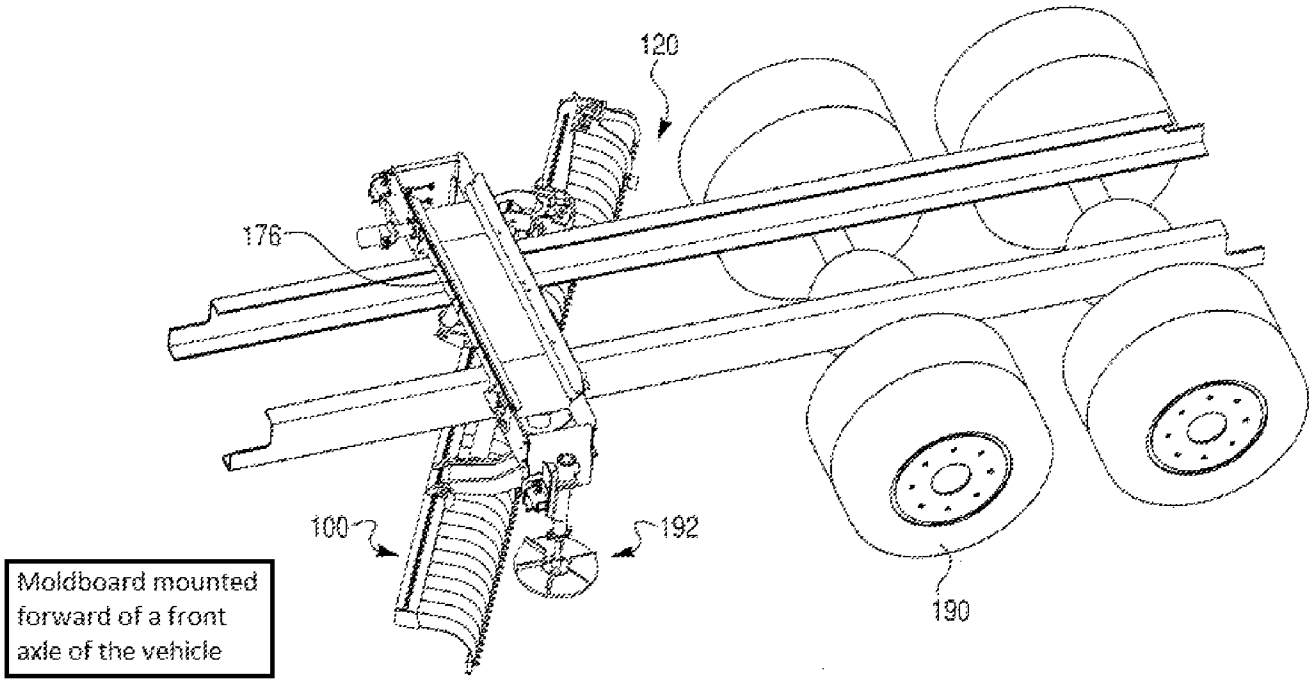
FIG. 5A is a top perspective view of a preferred embodiment of a finger plow mounted underneath a vehicle for right side discharge.

With reference now to FIG. 5A, the finger plow 100 and the extension 120 are mounted beneath the chassis of a vehicle between the front wheels (not shown) and the rear wheels 190. In the preferred embodiment, a spreader 192 for salt and sand is provided adjacent the left side of the finger plow 100 and immediately behind the finger plow 100. In this way, the spreader discharges salt and sand immediately behind the finger plow 100 and the extension 120. In practice, the grains of sand and particles of salt tend to be caught by any remaining ridges in snow and ice on the pavement to facilitate melting of such snow and ice.

A suitable conveyor 176 is provided to conduct salt and sand to the spreader from a bin (not shown) on the vehicle.

Figure 5B:
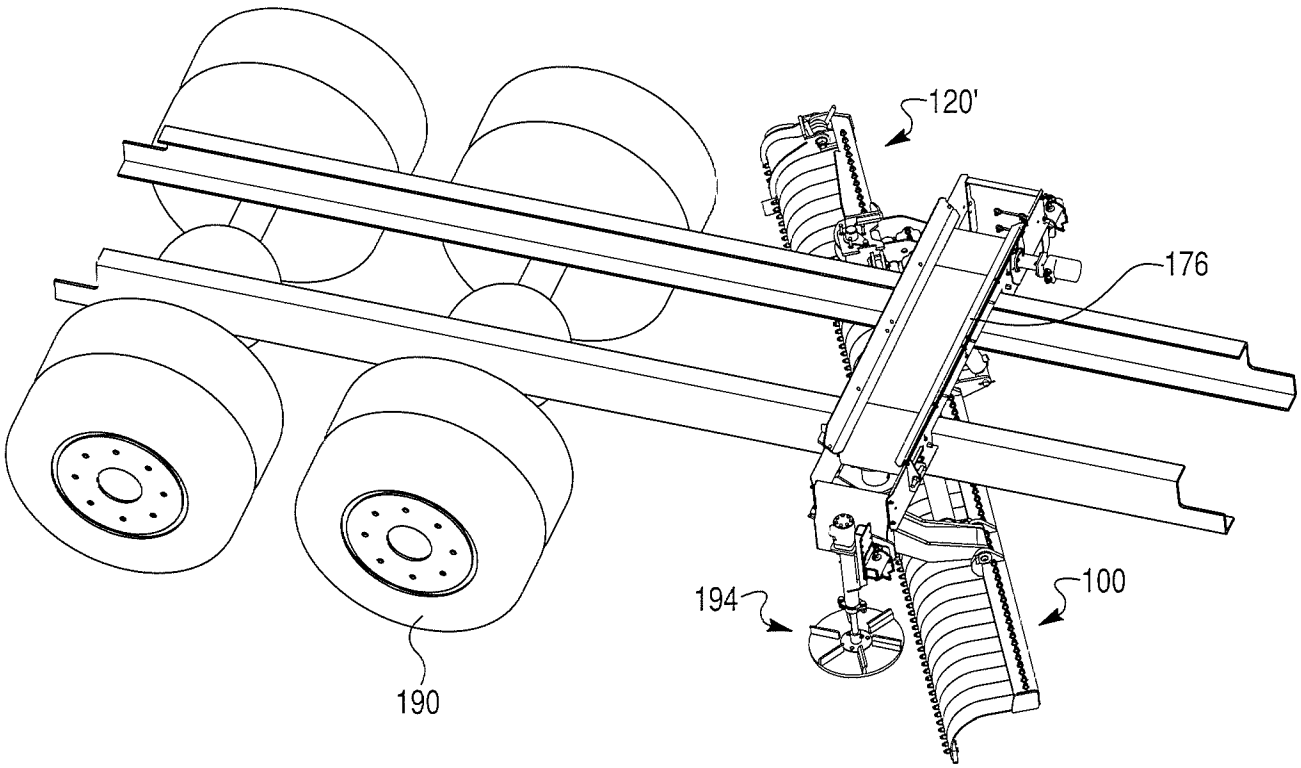
FIG. 5B is a top perspective view of a preferred embodiment of a finger plow mounted underneath a vehicle for left side discharge and FIG. 5C is a top perspective view of a preferred embodiment of a finger plow showing a right hand spreader in a generally horizontal and inactive position during a right hand discharge plowing configuration.

With reference now to FIG. 5B, the finger plow 100 and a left side extension 120' are mounted beneath the chassis of a vehicle between the front wheels (not shown) and the rear wheels 190 with the finger plow 100 arranged for left side discharge. In this preferred embodiment, a spreader 194 for salt and sand is provided adjacent the right side of the finger plow 100 and immediately behind the finger plow 100. In this way, the spreader discharges salt and sand immediately behind the finger plow 100 and the left side extension 120'. In practice, the grains of sand and particles of salt tend to be caught by any remaining ridges in snow and ice on the pavement to facilitate melting of such snow and ice.

In the embodiment of FIG. 5B, a suitable conveyor 176 is provided to conduct salt and sand to the spreader from a bin (not shown) on the vehicle.

Figure 10:
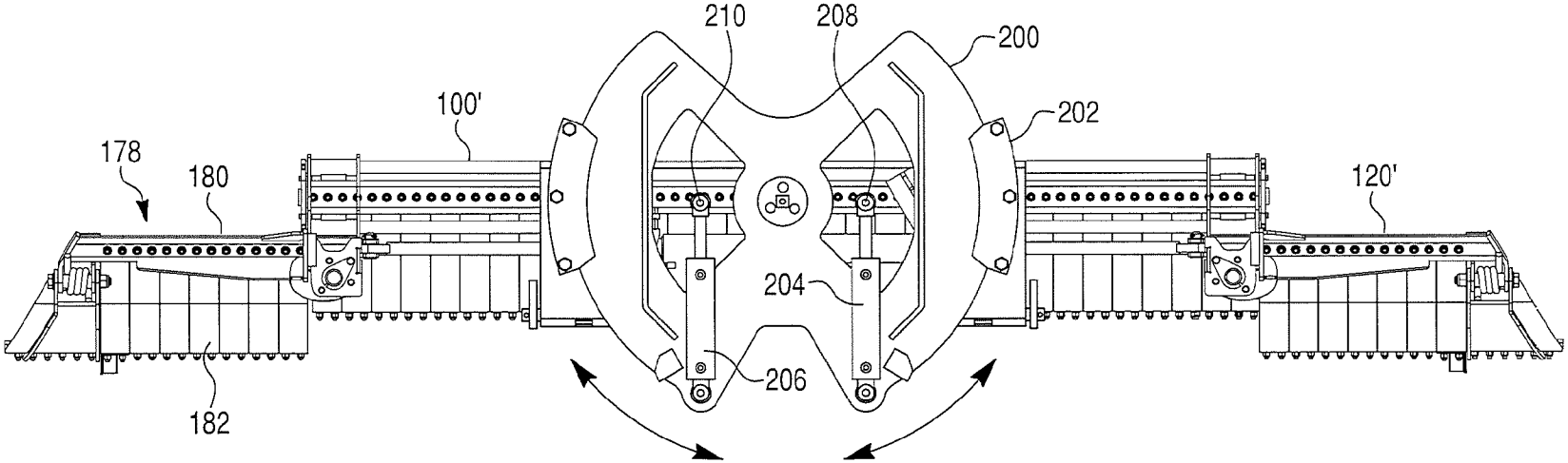
FIG. 10 is a top view of a preferred embodiment of a reversible finger plow with a left side extension and a right side extension.

With reference now to FIG. 10, a reversible finger plow 100' is shown in an intermediate position beneath the vehicle with a right side extension 120' in an extended position. A left side extension 178 is provided for the finger plow 100' to extend the finger plow toward the left side of the vehicle, as desired. The left side extension 178 corresponds generally to the right side extension 120' in size and configuration. The left side extension 178 has a third frame member 180 with a plurality of fingers 182 releasably mounted on the third frame member in a manner corresponding to the right side extension 120'. In addition, a second hydraulic cylinder is provided to selectively move the left side extension 178 between a retracted position and an extended position. The second hydraulic cylinder may be provided above or below the first hydraulic cylinder or may be in front of or behind the first hydraulic cylinder as desired.

Figure 5C:
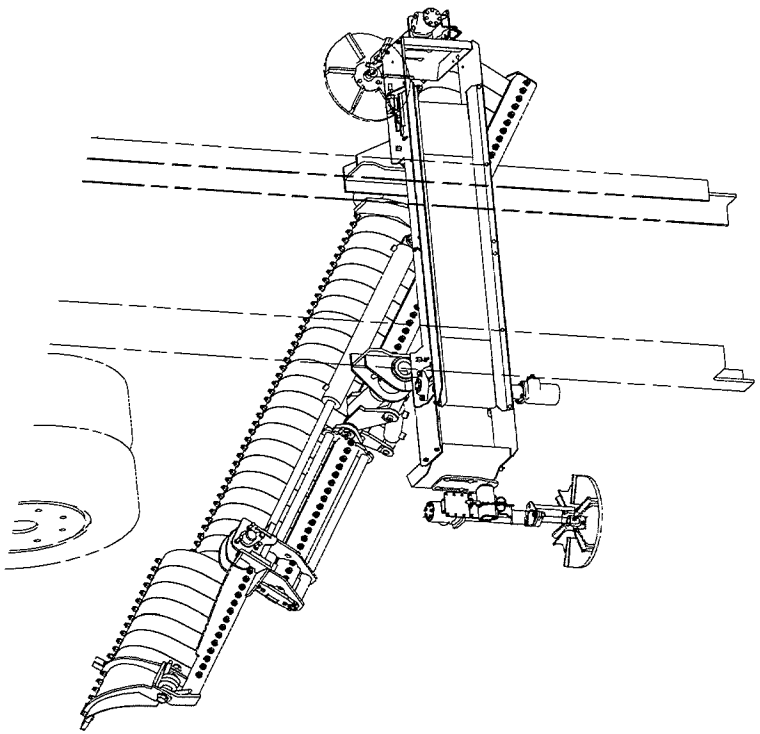

As shown in FIG. 10, the finger plow 100' may be mounted on the vehicle as a reversible plow for both right side discharge and for left side discharge. For example, the finger plow 100' may be carried by a support member 200 which is attached to the finger plow 100' by support brackets 202. The finger plow 100' may be moved between a right side discharge position and a left side discharge position by a pair of hydraulic cylinders 204, 206 which are provided between the support member 200 and the finger plow 100'. One end of each hydraulic cylinder 204, 206 is mounted to the support member 200 and another end of each hydraulic cylinder 204, 206 is mounted to the finger plow 100' at couplings 208, 210. By extending one of the hydraulic cylinders and retracting the other hydraulic cylinder, the finger plow 100' may be selectively oriented with respect to the vehicle for right side discharge and for left side discharge. In such a configuration, it may be desirable to only extend the right side extension during right side discharge plowing operations and to only extend the left side extension during left side discharge plowing operations. In a reversible plow configuration, two spreaders (not shown) may be provided on the left side of the vehicle and on the right side of the vehicle to selectively discharge salt and sand during plowing operations. Depending on the position of such spreaders in a reversible finger plow arrangement, it may be necessary to swing one of the two spreaders to a generally horizontal home position and to secure it with a pin (not shown) during movement of the finger plow from a right side discharge position to a left side discharge position and vice versa. (See FIG. 5C.)

In the preferred embodiments, the finger plow is mounted beneath the chassis of a vehicle between the front and rear wheels but the finger plow and extension may be mounted in other positions such as in front of a vehicle, behind a vehicle, behind a conventional moldboard or behind a wing plow for a conventional moldboard arrangement.

In the preferred embodiments, the extension 120 enables the finger plow to extend at least about 10 inches to twelve inches and preferably about 27 inches beyond the outermost surface of the tires of the vehicle. The extension is retractable so as not to extend significantly beyond the outermost surface of the wheels of the vehicle when the finger plow is not being used in a plowing operation.

As discussed above, the finger plow extension is preferably mounted for pivotal movement about a vertical axis in the event that the extension encounters an obstacle such as a curb or manhole cover, etc. In the embodiment of FIG. 1, shear pins 144 are provided to maintain the finger plow extension in a preferred orientation until an obstruction is encountered which causes the shear pins to break and to permit the finger plow extension to pivot rearwardly. In that event, the shear pins need to be replaced which may be relatively difficult to accomplish during a plowing operation and may require that the finger plow be returned to a maintenance facility for servicing. Accordingly, in other preferred embodiments, the finger plow extension is resiliently maintained in a preferred orientation relative to the finger plow.

Figure 11:
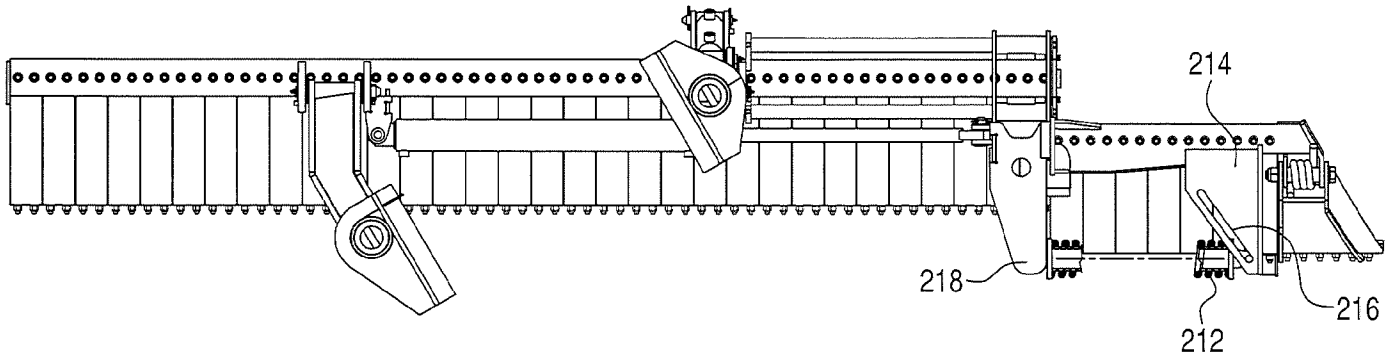
FIG. 11 is a top view of another preferred embodiment of a finger plow with an extension in an extended position.
Figure 12:
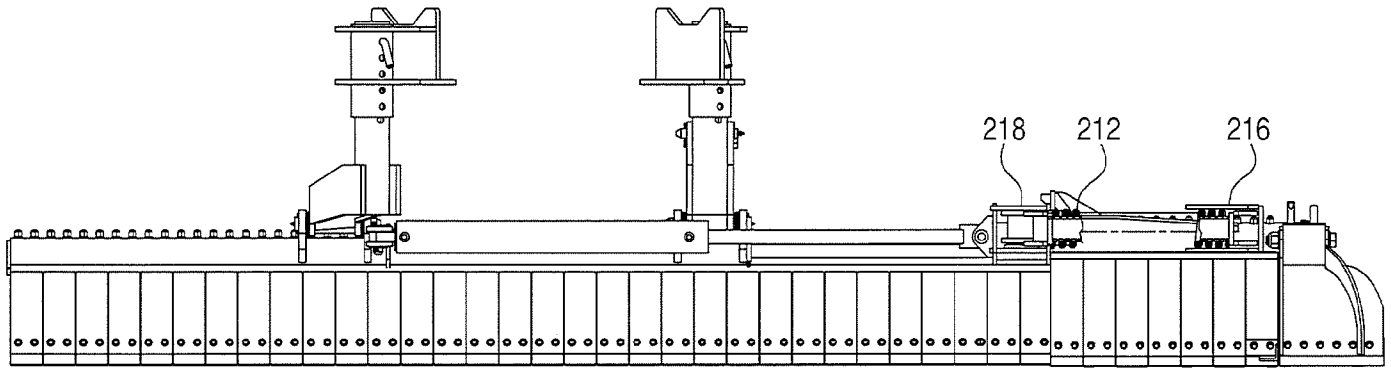
FIG. 12 is a rear view of the preferred embodiment of FIG. 11.
Figure 13:
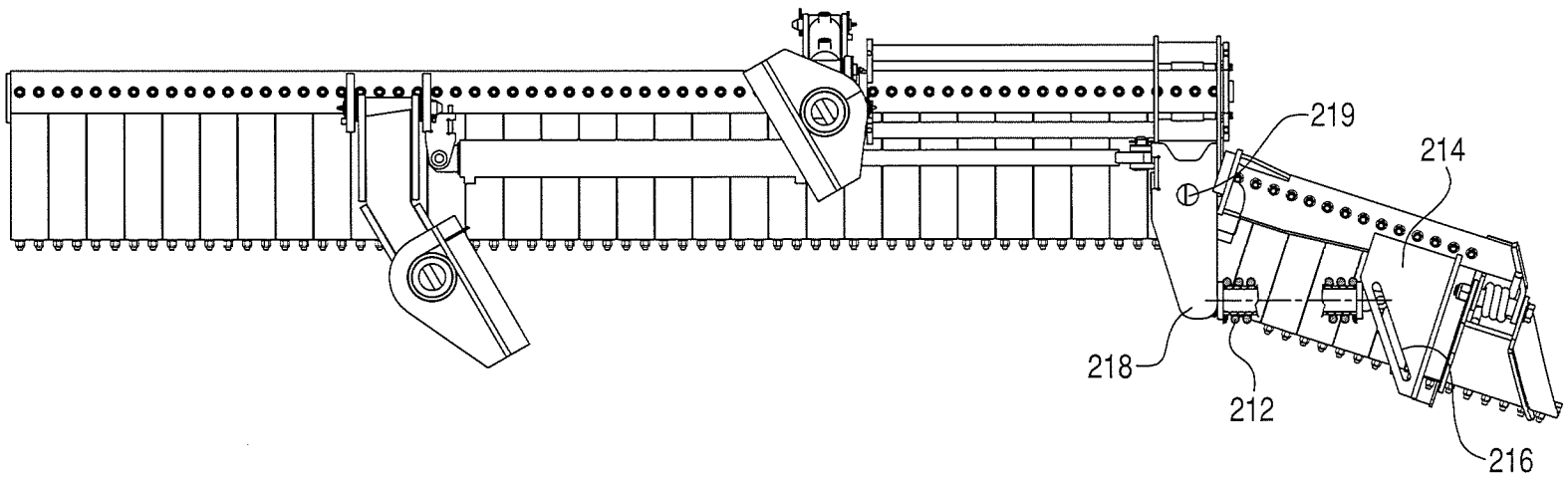
FIG. 13 is a top view of the preferred embodiment of a finger plow of FIG. 11 with the extension pivoted rearwardly.

With reference now to FIG. 11 and FIG. 12, a preferred embodiment of a finger plow which is resiliently maintained in a preferred orientation relative to the finger plow, has a spring 212 which is mounted between an end bracket 214 and another bracket 218. The end bracket 214 preferably has a slot 216 with an end of the spring 212 mounted in the slot 216. With reference now to FIG. 13, the end of the spring 212 is mounted in the slot 216 so that the end of the spring may slide relative to the end bracket 214 as the finger plow extension pivots rearwardly about a pivot pin 219 upon encountering an obstacle. After the obstacle has been passed, the spring 212 will urge the finger plow extension forward to return to the preferred orientation. By sliding the moving end of the spring 212 in the slot 216, the spring may be compressed or stretched (relaxed to preload) along the spring's horizontal straight axis without being significantly bent or damaged.

Figure 14:
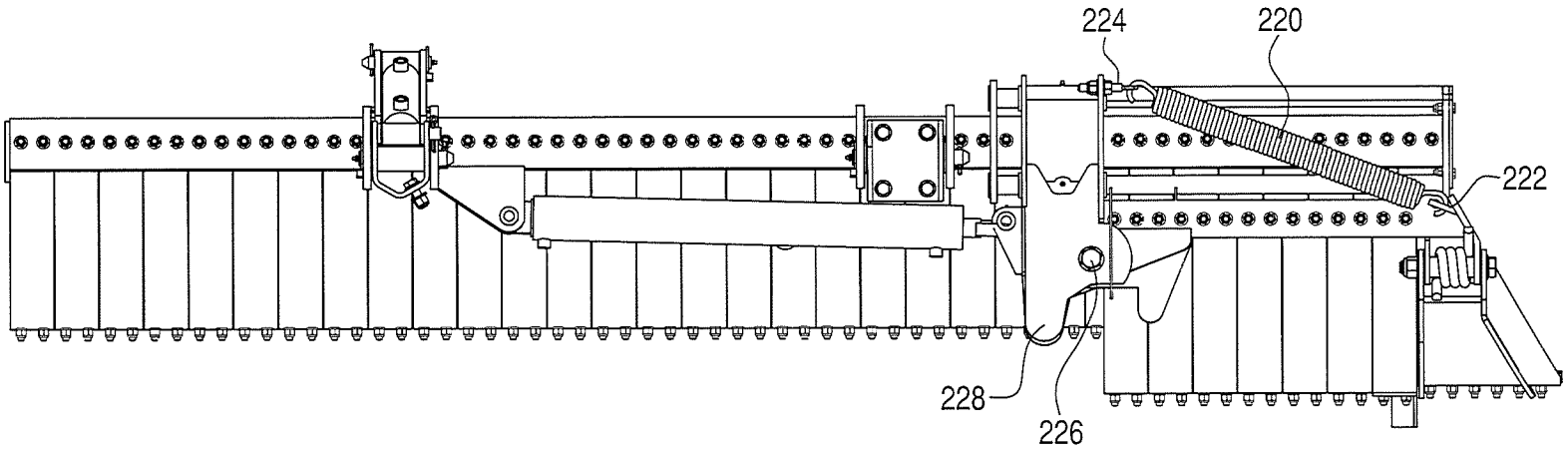
FIG. 14 is a top view of another preferred embodiment of a finger plow with an extension in a retracted position.

With reference now to FIG. 14, in another preferred embodiment, a spring 220 is provided between a bracket 228 and an end of the finger plow extension. An outermost end of the spring 220 is connected to the end of the finger plow extension at a hole 222. The other end of the spring 220 is connected to the bracket 228 at a hole 224. In the event that the finger plow extension encounters an obstacle, the finger plow extension may pivot about a pivot pin 226 which stretches the spring 220. After the obstacle has been passed, the spring urges the finger plow extension back to a preferred orientation relative to the finger plow.

Figure 15:
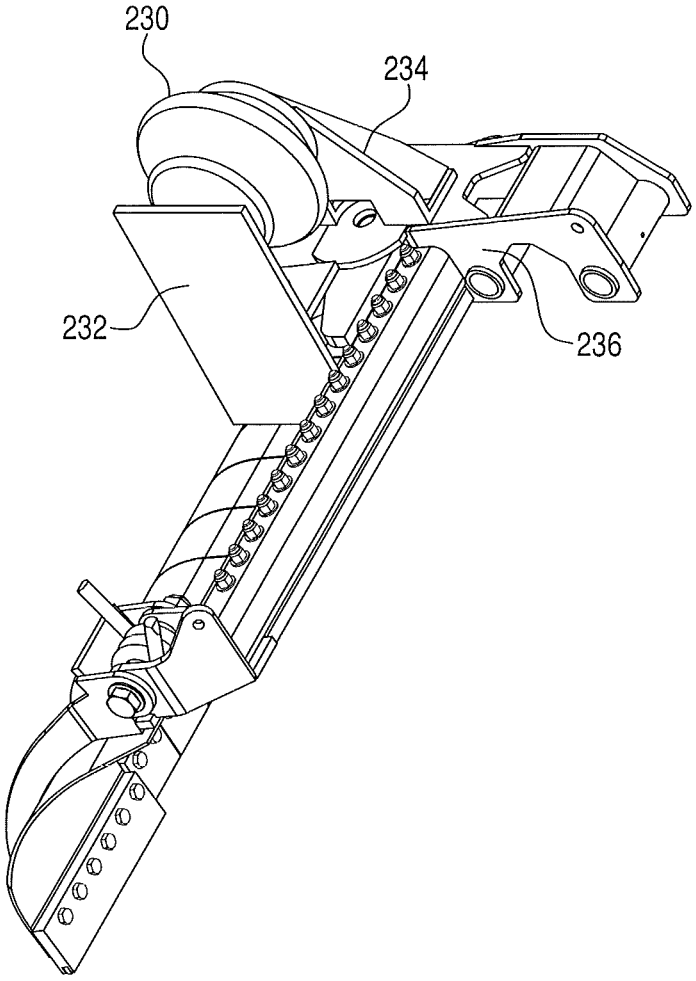
FIG. 15 is a view of another preferred embodiment of an extension for a finger plow.

With reference now to FIG. 15, the resilient member that maintains the finger plow extension in a preferred orientation may comprise an air bladder 230 which is provided between a plate 232 and an extension 234 of a bracket 236. The bracket 236 carries the finger plow extension between a retracted position and an extended position as discussed above in connection with the embodiment of FIG. 1. The finger plow extension is mounted so as to pivot relative to the bracket 236 in the event that the finger plow extension encounters an obstacle. As the finger plow pivots rearwardly, the air bladder 230 is compressed which resiliently tries to maintain the finger plow extension in the preferred orientation with respect to the finger plow. After the obstacle has been passed, the compressed air bladder 230 urges the finger plow extension forwardly to the preferred orientation relative to the finger plow.

Figure 16:
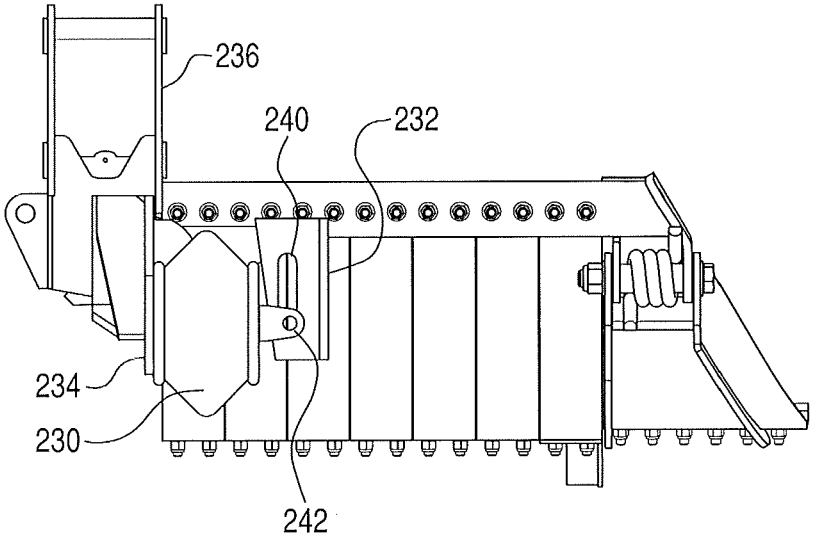
FIG. 16 is a top view of the embodiment of FIG. 15.
Figure 17:
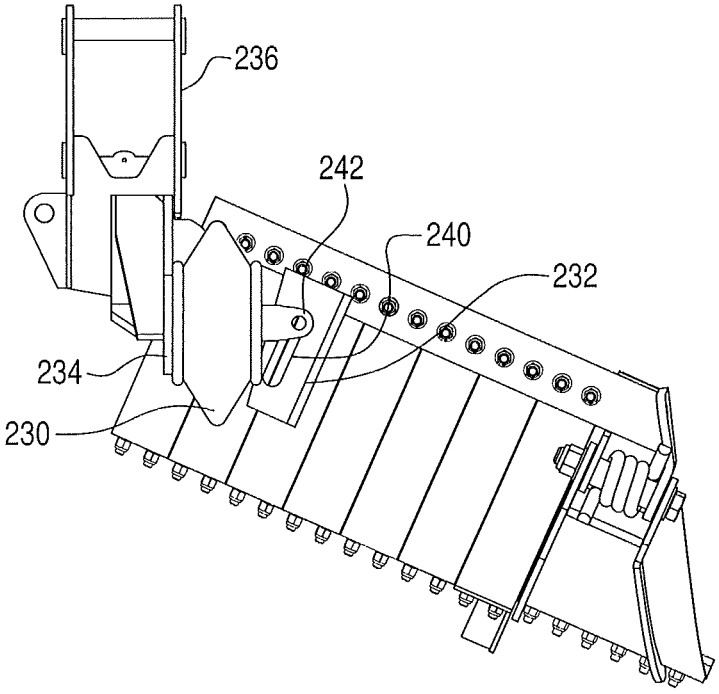
FIG. 17 is a top view of the embodiment of FIG. 15 with the extension pivoted rearwardly.

With reference to FIG. 16, one side of the air bladder 230 is preferably mounted on the bracket extension 234 with the other side of the air bladder having an arm 242 which is slidingly mounted in a slot 240 of the bracket 232. With reference to FIG. 17, upon encountering an obstacle, the finger plow extension pivots rearwardly relative to the bracket 236 and the arm 242 slides along the slot 240.

Figure 18:
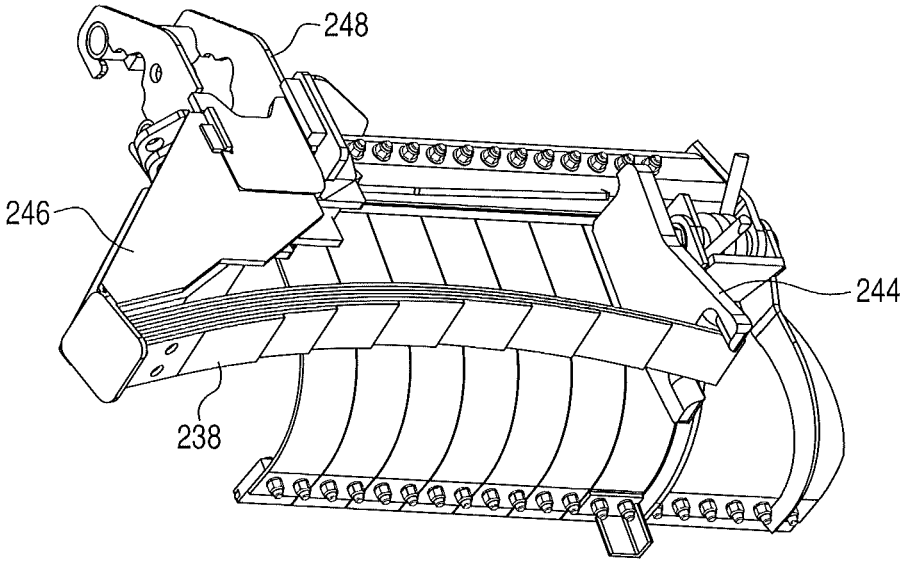
FIG. 18 is a view of another preferred embodiment of an extension for a finger plow; and, FIG. 19 is a top view of the extension of FIG. 18.
Figure 19:
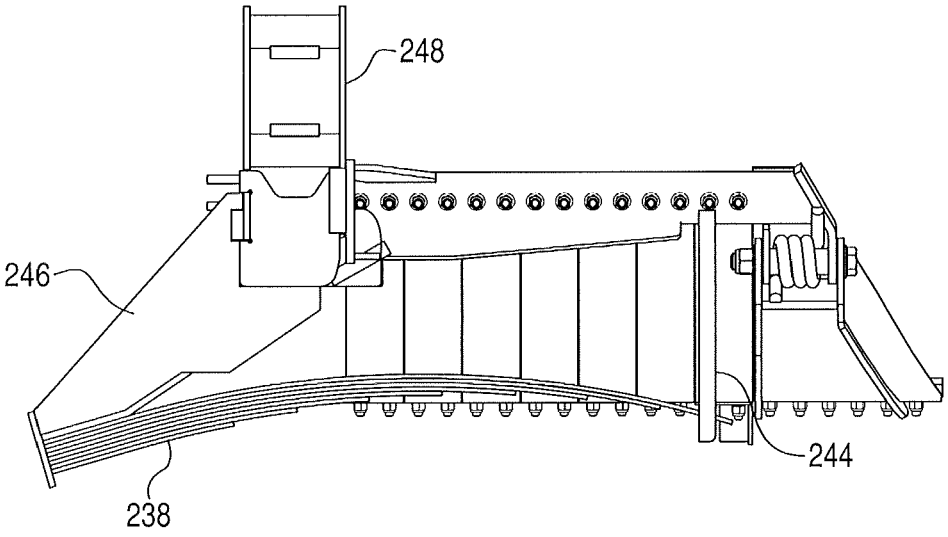

With reference now to FIG. 18 and to FIG. 19, the resilient mechanism that maintains the finger plow extension in a preferred orientation relative to the finger plow may comprise a set of leaf springs 238. A bracket 248 is provided to carry the finger plow extension and to move the finger plow extension between the extended and retracted positions. The bracket 248 has an arm 246 which receives one end of the leaf spring 238. The other end of the leaf spring 238 is mounted in a bracket 244 at an outermost end of the finger plow extension. As the finger plow extension pivots rearwardly upon encountering an obstacle, the leaf spring 238 is bent which resiliently urges the finger plow extension forwardly.

In operation, the finger plow is positioned for a plowing operation, preferably either for right side discharge or for left side discharge with a finger plow extension in an extended position during the plowing operation. The finger plow extension is preferably mounted for pivotal movement rearwardly in the event that the finger plow extension should encounter an obstacle. If the finger plow extension is resiliently maintained in a preferred orientation, the finger plow extension is then moved forwardly by the resilient mechanism after the obstacle has been passed.

The principles, preferred embodiments and mode of operation of the present invention have been described in the foregoing specification. However, the invention which is intended to be protected is not to be construed as limited to the particular embodiments disclosed. The embodiments are therefore to be regarded as illustrative rather than as restrictive. Variations and changes may be made without departing from the spirit of the present invention. Accordingly, it is expressly intended that all such equivalents, variations and changes which fall within the spirit and scope of the present invention as defined in the claims be embraced thereby.

What is claimed is:

1. A snow plow system for mounting to a vehicle, comprising:

a moldboard mounted forward of a front axle of the vehicle;

and a finger plow, the finger plow comprising:

a first frame;

a first plurality of fingers, each finger of the first plurality of fingers having a substantially straight portion and a substantially curved portion, said first plurality of fingers being carried by the first frame to form a finger plow for collecting snow from pavement;

a second frame;

a second plurality of fingers, each finger of the second plurality of fingers having a substantially straight portion and a substantially curved portion, said second plurality of fingers being carried by the second frame to form an extension of the finger plow, said second frame being movable relative to the first frame; and a bracket carrying the second frame, the second frame being pivotably mounted on the bracket for rotation relative to the first frame about a substantially vertical axis, the bracket being slidably mounted on a shaft for transversely moving the second frame relative to the first frame so that an outermost end of the extension of the finger plow selectively extends beyond an end of the finger plow, the bracket being rotatable when the second frame is transversely moved to any position along the shaft;

wherein a bottom of each of a front surface of the first and second plurality of fingers form an angle of at least 50 degrees to 90 degrees relative to the pavement in a forward direction of motion, each bottom of each of the front surfaces of the first and second plurality of fingers forming a deformable scraping edge when engaged with the pavement; and wherein the finger plow is mounted rearward of the front axle of the vehicle and forward of a rear axle of the vehicle.

2. The snow plow system of claim 1, further comprising a hydraulic cylinder arranged to extend and retract the second frame relative to the first frame.

3. The snow plow system of claim 1, said bracket further comprising a release mechanism which releasably prevents pivotal movement of the second frame relative to the bracket when the second frame is in the fully extended position.

4. The snow plow system of claim 3, wherein the release mechanism comprises at least one shear pin, said shear pin preventing said pivotal movement of said second frame relative to said bracket unless said shear pin is broken.

5. The snow plow system of claim 4, further comprising a chain, a first end of said chain being attached to said bracket and a second end of said chain being attached to said finger plow extension to limit rotation of said finger plow extension relative to said bracket when said shear pin is broken.

6. The snow plow system of claim 1, further comprising first and second mounting brackets for attaching said first frame of said finger plow to said vehicle.

7. The snow plow system of claim 6, wherein the extension of the finger plow is provided on a right end of said finger plow to form a right end extension of the finger plow.

8. The snow plow system of claim 7, further comprising:

a third frame;

a third plurality of fingers, each finger of the third plurality of fingers having a substantially straight portion and a substantially curved portion, said third plurality of fingers being carried by the third frame to form a left end extension of the finger plow, said third frame being movable relative to the first frame; and a second bracket carrying the third frame, the third frame being pivotably mounted on the second bracket for rotation relative to the first frame about a substantially vertical axis, the second bracket being slidably mounted for transversely moving the third frame relative to the first frame so that an outermost end of the left end extension of the finger plow selectively extends beyond a left end of the finger plow.

9. The snow plow system of claim 8, wherein the third frame pivots rearwardly from a fully extended position to a third position, an end of the third frame being closer to the vehicle when the third frame is at the third position than when the third frame is at the fully extended position.

10. The snow plow system of claim 1, further comprising first and second mounting brackets for attaching said first frame of said finger plow to said vehicle, underneath said vehicle and between front wheels and rear wheels of said vehicle.

11. The snow plow system of claim 10, wherein said frame of said finger plow is fixedly mounted to said vehicle to discharge snow and ice to a right side of said vehicle.

12. The snow plow system of claim 11, wherein the extension of the finger plow is provided on a right end of said finger plow to form a right end extension of the finger plow.

13. The snow plow system of claim 10, wherein said finger plow is a reversible plow with said frame of said finger plow being movably mounted to said vehicle to discharge snow and ice selectively to a right side of said vehicle or to a left side of said vehicle.

14. The snow plow system of claim 13, wherein the extension of the finger plow is provided on a right end of said finger plow to form a right end extension of the finger plow, said snow plow further comprising:

a third frame;

a third plurality of fingers, each finger of the third plurality of fingers having a substantially straight portion and a substantially curved portion, said third plurality of fingers being carried by the third frame to form a left end extension of the finger plow, said third frame being movable relative to the first frame; and a second bracket carrying the third frame, the third frame being pivotably mounted on the second bracket for rotation relative to the first frame about a substantially vertical axis, the second bracket being slidably mounted for transversely moving the third frame relative to the first frame so that an outermost end of the left end extension of the finger plow selectively extends beyond a left end of the finger plow.

15. The snow plow system of claim 13 wherein a left-hand spreader for salt and sand is provided adjacent a left end of said finger plow and a right-hand spreader for salt and sand is provided adjacent a right end of said finger plow.

16. The snow plow system of claim 15 wherein the left-hand spreader for salt and sand and the right-hand spreader for salt and sand may each be moved to a generally horizontal position in which the spreader is inactive and may be secured during a plowing operation.

17. The snow plow system of claim 14, wherein the third frame pivots rearwardly from a fully extended position to a third position, an end of the third frame being closer to the vehicle when the third frame is at the third position than when the third frame is at the fully extended position.

18. The snow plow system of claim 10, wherein a spreader for salt and sand is provided adjacent a right end of said finger plow.

19. The snow plow system of claim 1, further comprising:

a plurality of cable brackets, each cable bracket being mounted on one of said first and second plurality of fingers;

a cable connecting said plurality of cable brackets, whereby a finger which becomes broken may be retained by said cable during a plowing operation.

20. The snow plow system of claim 1, wherein said bracket further comprising a resilient mechanism which resiliently prevents pivotal movement of the second frame relative to the bracket.

21. The snow plow system of claim 20 wherein the resilient mechanism comprises a spring.

22. The snow plow system of claim 21 wherein the spring is compressed when the second frame pivots rearwardly.

23. The snow plow system of claim 21 wherein the spring is stretched when the second frame pivots rearwardly.

24. The snow plow system of claim 21 wherein the spring comprises a leaf spring.

25. The snow plow system of claim 20 wherein the resilient mechanism comprises a chamber filled with a compressible fluid, said chamber being compressed when said second frame pivots rearwardly.

26. The snow plow system of claim 1, wherein the second frame pivots rearwardly from a fully extended position to a second position, an end of the second frame being closer to the vehicle when the second frame is at the second position than when the second frame is at the fully extended position.

27. The snow plow system of claim 1, wherein the first and second plurality of fingers are urged downward towards the pavement by a relatively constant amount of downward pressure supplied from a hydraulic cylinder and being applied onto the first and second plurality of fingers.

* * * * *